US008608166B2

(12) United States Patent
Iguchi et al.

(10) Patent No.: US 8,608,166 B2
(45) Date of Patent: Dec. 17, 2013

(54) DECOLORING APPARATUS AND SHEET CONVEYANCE CONTROL METHOD

(75) Inventors: Ken Iguchi, Shizuoka-ken (JP); Hiroyuki Tsuchihashi, Shizuoka-ken (JP); Isao Yahata, Shizuoka-ken (JP); Takahiro Kawaguchi, Shizuoka-ken (JP); Hiroyuki Taguchi, Shizuoka-ken (JP); Hiroyuki Taki, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/192,074

(22) Filed: Jul. 27, 2011

(65) Prior Publication Data

US 2012/0025454 A1 Feb. 2, 2012

Related U.S. Application Data

(60) Provisional application No. 61/368,612, filed on Jul. 28, 2010, provisional application No. 61/368,626, filed on Jul. 28, 2010, provisional application No. 61/372,428, filed on Aug. 10, 2010.

(51) Int. Cl.

| | |
|---|---|
| ***B65H 39/10*** | (2006.01) |
| ***B65H 43/00*** | (2006.01) |
| ***B41J 2/325*** | (2006.01) |

(52) U.S. Cl.

USPC ..... 271/298; 347/179; 271/176; 271/302; 271/303

(58) Field of Classification Search

USPC ..... 271/298, 300–303, 176; 347/179

See application file for complete search history.

(56) References Cited

U.S. PATENT DOCUMENTS

| | | | | |
|---|---|---|---|---|
| 6,161,828 | A * | 12/2000 | Sussmeier | 270/59 |
| 2004/0207153 | A1 * | 10/2004 | Kida | 271/298 |
| 2010/0118361 | A1 | 5/2010 | Iguchi | |
| 2010/0219580 | A1 * | 9/2010 | Hamasaki et al. | 271/265.01 |
| 2010/0315475 | A1 * | 12/2010 | Taki et al. | 347/179 |
| 2010/0321457 | A1 | 12/2010 | Kawaguchi et al. | |

FOREIGN PATENT DOCUMENTS

| | | |
|---|---|---|
| JP | 10214005 | 8/1998 |

* cited by examiner

*Primary Examiner* — Patrick Cicchino

(74) *Attorney, Agent, or Firm* — Patterson & Sheridan, L.L.P.

(57) ABSTRACT

A sheet conveyance control method in an apparatus including a first conveying path for leading a sheet from a feeing port to a discharge port, a second sheet conveying path for leading the sheet to another conveyance destination, and a decoloring processing section configured to decolor an image formed on the sheet includes: detecting the length of the sheet further on a downstream side than the feeding port and further on an upstream side than a branching point of the first and second sheet conveying paths in a sheet conveying direction of the first sheet conveying path; and changing, if the trailing end of the sheet is not detected in a period after the leading end of the sheet is detected and before the leading end of the sheet reaches the branching point, a first flapper to a state in which the sheet is conveyed to the discharge port.

19 Claims, 10 Drawing Sheets

DECOLORING APPARATUS AND SHEET CONVEYANCE CONTROL METHOD

CROSS-REFERENCE TO RELATED APPLICATION(S)

This application is based upon and claims the benefit of priority from: U.S. provisional application 61/368612, filed on Jul. 28, 2010; U.S. provisional application 61/368626, filed on Jul. 28, 2010; and U.S. provisional application 61/372428, filed on Aug. 10, 2010; the entire contents all of which are incorporated herein by reference.

FIELD

Embodiments described herein relate generally to a decoloring apparatus that applies predetermined decoloring processing to an image formed on a sheet with a decolorable colorant to thereby decolor the image.

BACKGROUND

In the past, there is known a technique for switching a conveying path in order to convey a sheet subjected to decoloring processing to any one of plural predetermined conveyance destinations.

However, in detecting the length of a sheet while conveying the sheet, depending on the length of a sheet to be subjected to decoloring processing, the leading end of the sheet reaches a branching point of a conveying path before the total length of the sheet is found. In such a case, the conveying path cannot be switched.

DETAILED DESCRIPTION

In general, according to one embodiment, an image forming apparatus includes a first sheet conveying path, a second sheet conveying path, a decoloring processing section, a first flapper, a sensor, and a path control section.

The first sheet conveying path leads a sheet, which is fed from a feeding port, to a discharge port.

The second sheet conveying path branches from the first sheet conveying path and leads the sheet, which is conveyed through the first sheet conveying path, to another conveyance destination.

The decoloring processing section decolors, between the feeding port to the branching path in the first sheet conveying path, an image formed on the sheet with a decolorable colorant.

The first flapper switches a conveyance destination of the sheet, which is conveyed through the first sheet conveying path, to the discharge port in the first sheet conveying path or to the second sheet conveying path.

The sensor is located further on a downstream side than the feeding port and located further on an upstream side than a branching point of the first sheet conveying path and the second sheet conveying path in a sheet conveying direction of the first sheet conveying path and detects the length of the sheet conveyed through the first sheet conveying path.

If the trailing end of the sheet is not detected in a period after the sensor detects the leading end of the sheet and before the leading end of the sheet reaches the branching point, the path control section changes the first flapper to a state in which the sheet is conveyed to the discharge port.

First Embodiment

First, a first embodiment is explained with reference to the drawings.

Figure 1:
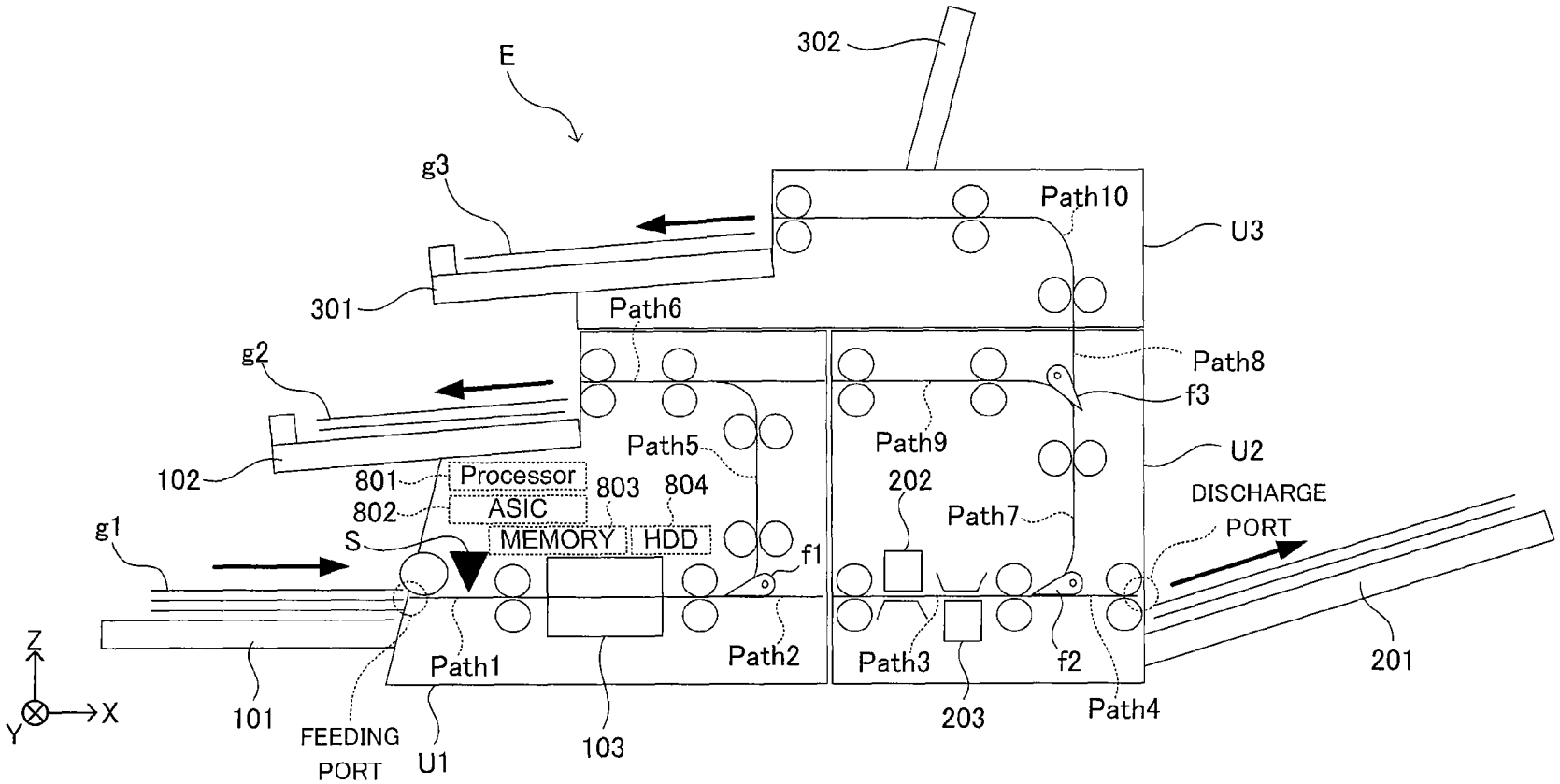
FIG. 1 is a longitudinal sectional view of a schematic configuration of a decoloring apparatus E according to a first embodiment.
Figure 2:
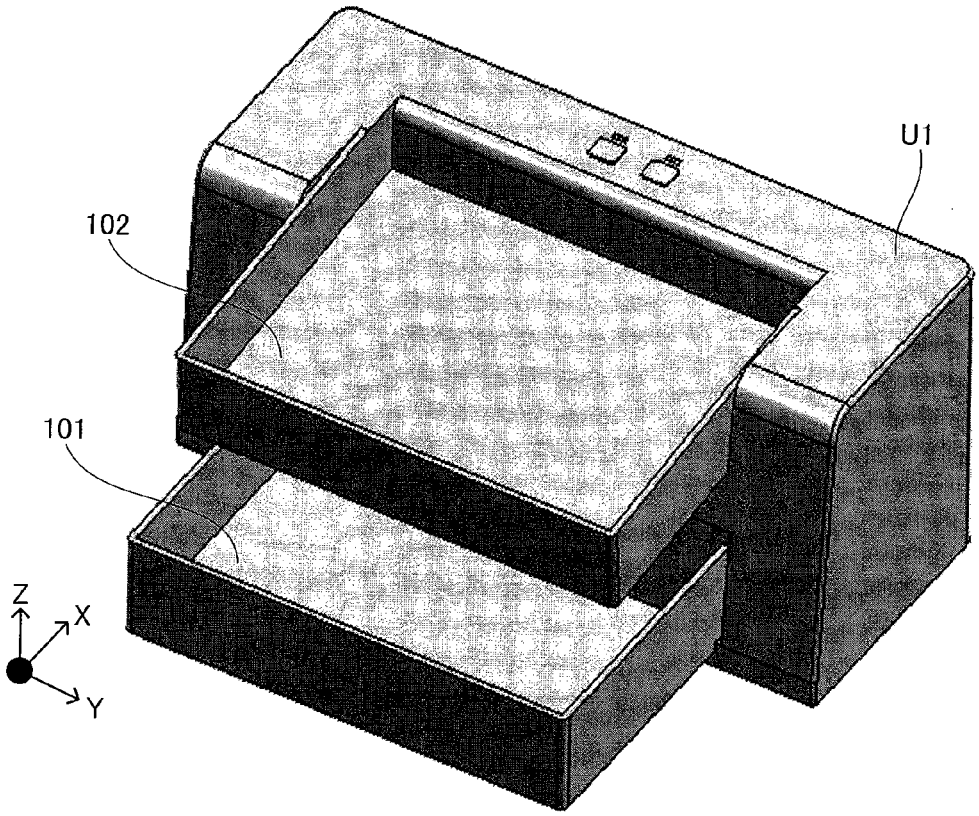
FIG. 2 is an external perspective view of a schematic configuration of a unit U1 in the decoloring apparatus E.
Figure 3:
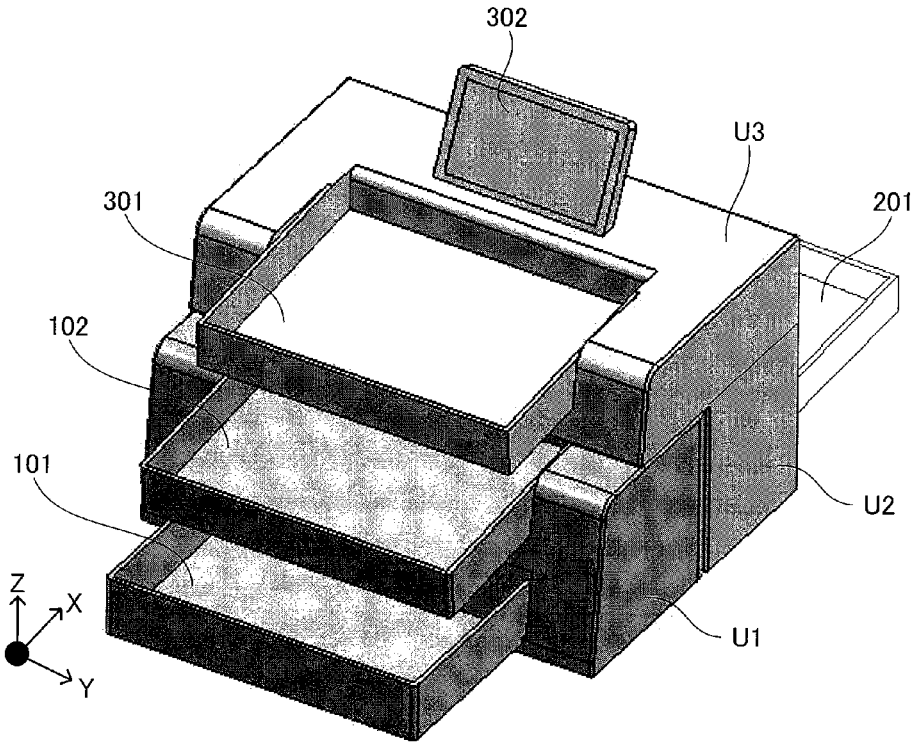
FIG. 3 is an external perspective view of the schematic configuration of the decoloring apparatus E.

FIG. 1 is a longitudinal sectional view of a schematic configuration of a decoloring apparatus E. FIG. 2 is an external perspective view of a schematic configuration of a unit U1 in the decoloring apparatus E. FIG. 3 is an external perspective view of the schematic configuration of the decoloring apparatus E.

The decoloring apparatus E includes three units, i.e., a unit U1, a unit U2, and a unit U3. The unit U1 has a role of a main body of the decoloring apparatus and includes a basic function for applying decoloring processing to a sheet.

The unit U2 is detachably attachable to a back side (a side on which a discharge tray is not provided) of the unit U1. The unit U3 is detachably attachable to upper parts of the unit U1 and the unit U2. As a mechanism for detachably coupling these units, various publicly-known mechanisms can be used.

The unit U1 includes a sheet conveying path Path1, a sheet conveying path Path2, a sheet conveying path Path5, a sheet conveying path Path6, a sensor S, a flapper f1, a sheet feeding tray 101, a discharge tray 102, and a decoloring processing section 103. The unit U1 alone can operate as a decoloring apparatus.

Sheets g1 to be conveyed are fed to the sheet conveying path Path1 from the sheet feeding tray 101. The sheet conveying path Path1 branches to the sheet conveying path Path2 and the sheet conveying path Path5. Sheets conveyed through the sheet conveying path Path1 are switched by the flapper f1 to be led to the sheet conveying path Path2 or the sheet conveying path Path5. The sheets conveyed through the sheet conveying path Path5 merge into the sheet conveying path Path6. The sheets passed through the sheet conveying path Path6 are discharged onto the discharge tray 102 and sequentially stacked (see sheets g2).

The sheet conveying path Path1 and the sheet conveying path Path2 form a continuous straight path. The decoloring processing section 103 is arranged further on a downstream side than the sheet feeding tray 101 and further on an upstream side than a branching point of the sheet conveying paths in a direction of sheet conveyance by the sheet conveying path Path1. The optical reflective sensor S is arranged further on the downstream side than the sheet feeding tray 101 (a feeding port) and further on the upstream side than the decoloring processing section 103 (further on the upstream side than a branching point of the first sheet conveying path and the second sheet conveying path) in the direction of sheet conveyance by the sheet conveying path Path1. The sensor S does not always have to be the reflective optical sensor and can be, for example, a transmissive optical sensor or a mechanical sensor including a lever. A scanner can be used as a line sensor.

The sensor S detects the leading end and the trailing end in the sheet conveying direction of the sheet g1 conveyed through the sheet conveying path Path1. In this way, the leading end and the trailing end of a sheet being conveyed is detected by the sensor S, whereby the length of the sheet in the conveying direction can be known.

The sensor S can detect the thickness of the sheet g1 conveyed through the sheet conveying path Path1. In the detection of the thickness of the sheet, for example, if the sensor S is the mechanical sensor explained above, the sensor S can calculate the thickness of the sheet on the basis of a rotation angle of the lever.

The decoloring processing section 103 decolors an image formed on a sheet with a decolorable colorant.

The unit U2 includes a sheet conveying path Path3, a sheet conveying path Path4, a sheet conveying path Path7, a sheet conveying path Path8, a sheet conveying path Path9, a discharge tray 201, a scanner 202, a scanner 203, a flapper f2, and a flapper f3. A sheet led to the sheet conveying path Path2 by the flapper f1 in the unit U1 enters the sheet conveying path Path3 of the unit U2.

The sheet conveying path Path3 branches to the sheet conveying path Path4 and the sheet conveying path Path7 at a branching point and can convey sheets in two directions. Sheets are switched by the flapper f2 (equivalent to the first flapper) to be led in the direction of the sheet conveying path Path4 or the sheet conveying path Path7. The sheet conveying path Path3 and the sheet conveying path Path4 form a continuous straight path. The sheets led to the sheet conveying path Path4 are discharged onto the discharge tray 201 from a discharge port provided in the back of the apparatus and stacked.

The sheet conveying paths Path1 to Path4 are equivalent to the "first sheet conveying path" for leading a sheet, which is fed from the sheet feeding tray 101 to the feeding port, to the discharge port. The sheet conveying paths Path1 to Path4 as a whole form a continuous straight path.

The sheet conveying path Path7 (the second sheet conveying path) branches to the sheet conveying paths Path8 and the sheet conveying path Path9 at a branching point and can convey sheets in two directions. Sheets are switched by the flapper f3 to be led to the sheet conveying path Path8 or the sheet conveying path Path9. The sheets led to the sheet conveying path Path8 enter a sheet conveying path Path10 of the unit U3. The sheets led to the sheet conveying path Path9 enter the sheet conveying path Path6 of the unit U1 and are discharged onto the discharge tray 102.

The scanners 202 and 203 are arranged further on the downstream side than a sheet entrance port from the unit U1 (further on the downstream side than the decoloring processing section) and further on the upstream side than a branching point of the sheet conveying paths in the direction of sheet conveyance by the sheet conveying path Path3. The scanner 202 reads an image on the upper surface of a sheet and the scanner 203 reads an image on the lower surface of the sheet. The scanners 202 and 203 are arranged to read the upper surface of the sheet and then read the lower surface of the sheet. However, the scanners 202 and 203 may be arranged oppositely as long as the scanners 202 and 203 can eventually read the images on both the surfaces of the sheet.

In this way, the scanners 202 and 203 (image reading sections) read an undecolored image or the like (a decolored state) remaining on the sheet decolored by the decoloring processing section 103. This makes it possible to determine whether the decoloring processing is successful.

The unit U3 includes a sheet conveying path Path10, a discharge tray 301, and a display section 302. The display section 302 can include a touch panel display on which operation input such as button operation and screen display can be performed.

Sheets led to the sheet conveying path Path8 by the flapper f3 (a second flapper) in the unit U2 enter the sheet conveying path Path10 of the unit U3. The flapper f3 switches a sheet conveyance destination to any one of plural conveyance destinations of the sheets led from the first sheet conveying path.

The sheets entering the sheet conveying path Path10 are discharged onto the discharge tray 301 and stacked.

The display section 302 displays information concerning processing contents in the decoloring apparatus.

Each of the sheet conveying paths Path1 to Path10 include plural conveying rollers for nipping and conveying sheets.

The decoloring apparatus E includes a processor 801, an ASIC (Application Specific Integrated Circuit) 802, a memory 803, and a HDD (Hard Disk Drive) 804.

The processor 801 controls various kinds of processing performed in the decoloring apparatus E such as turn-on and turn-off and conveying speed control for the plural conveying rollers included in each of the sheet conveying paths Path1 to Path10, driving of the flappers f1 to f3, sheet conveying speed and temperature control in the decoloring processing section 103, and control of image reading processing in the scanners 202 and 203.

In the decoloring apparatus E according to this embodiment, the processor 801 also has a role of realizing various functions by executing computer programs stored in the memory 803, the HDD 804, and the like. It goes without saying that the processor 801 can also be realized by a CPU (Central Processing Unit) or an MPU (Micro Processing Unit) that can execute equivalent arithmetic processing. Similarly, the HDD 804 can be replaced with a storage device such as a flash memory.

The memory 803 can include, for example, a RAM (Random Access Memory), a ROM (Read Only Memory), a DRAM (Dynamic Random Access Memory), an SRAM (Static Random Access Memory), a VRAM (Video RAM), or a flash memory. The memory 803 has a role of storing various kinds of information and computer programs used in the decoloring apparatus E.

The HDD 804 (a storing section) stores image data read from a sheet by the scanners 202 and 203.

With such a configuration, it is possible to perform sorting and discharge for, according to a result of the decoloring processing in the decoloring processing section 103, for example, discharging an insufficiently-decolored sheet to the discharge tray 102 and discharging a sufficiently-decolored sheet to the discharge tray 301.

Figure 4:
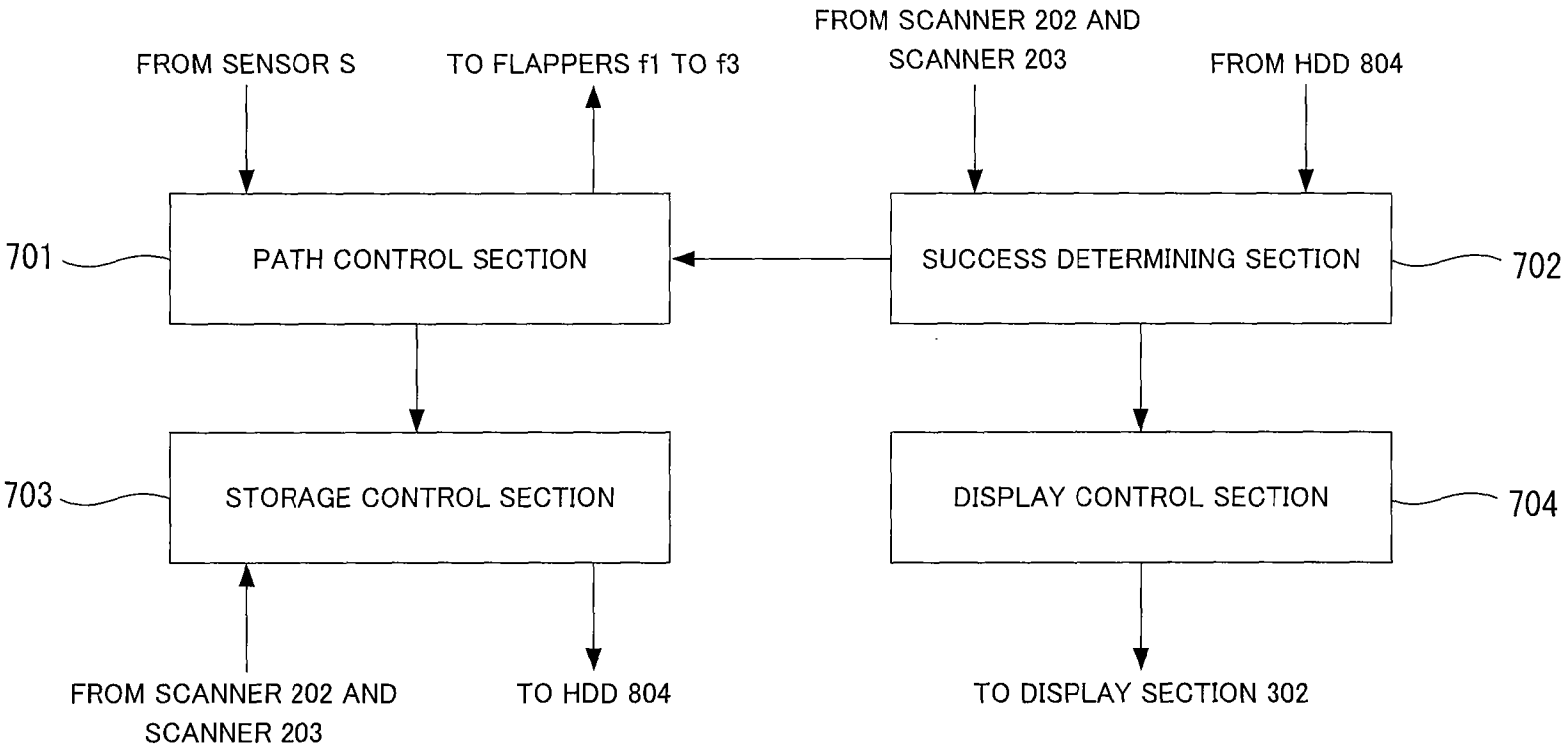
FIG. 4 is a functional block diagram for explaining the decoloring apparatus E.

FIG. 4 is a functional block diagram for explaining the decoloring apparatus E.

The decoloring apparatus E includes a path control section 701, a success determining section 702, a storage control section 703, and a display control section 704.

If the trailing end of a sheet is not detected in a period after the leading end of the sheet is detected by the sensor S and before the leading end of the sheet reaches a branching point of the flapper f2, the path control section 701 changes the flapper f2 (the first flapper) to a state in which the sheet is conveyed to the discharge port.

In the period after the sensor S detects the leading end of the sheet and before the leading end of the sheet reaches the branching point, the path control section 701 sets the flapper f2 (the first flapper) in a state in which the sheet is conveyed to the discharge port. If the trailing end of the sheet is detected in the period after the sensor S detects the leading end of the sheet and before the leading end of the sheet reaches the branching point, the path control section 701 changes the first flapper to a state in which the sheet is led to the second sheet conveying path.

The path control section 701 switches the flapper f3 (the second flapper) on the basis of a determination result in the success determining section 702.

If the trailing end of the sheet is not detected in the period after the leading end of the sheet is detected by the sensor S and before the leading end of the sheet reaches the branching point, the path control section 701 does not cause the flapper f3 (the second flapper) to operate.

If the trailing end of the sheet is not detected in the period after the leading end of the sheet is detected by the sensor S and before the leading end of the sheet reaches the branching point, the path control section 701 does not drive at least any one of the plural conveying rollers.

The success determining section 702 determines success of decoloring processing on the sheet on the basis of image data read by the scanners 202 and 203 (the image reading sections).

If the trailing end of the sheet is not detected in the period after the leading end of the sheet is detected by the sensor S and before the leading end of the sheet reaches the branching point in the path control section 701, the storage control section 703 does not cause the HDD 804 (the storing section) to store data used for only the success determination in the success determining section 702 among data including at least the image data read from the sheet by the image reading sections. Consequently, it is possible to realize effective use of a storage area and reduce a processing load due to unnecessary data transfer.

Further, if the trailing end of the sheet is not detected in the period after the leading end of the sheet is detected by the sensor S and before the leading end of the sheet reaches the branching point in the path control section 701, the storage control section 703 may stop the scanning process by the scanners 202 and 203.

If the path control section 701 changes the flapper f2 (the first flapper) to a state in which the sheet is conveyed to the discharge port and discharges the sheet from the discharge port, the display control section 704 causes the display section 302 to screen-display to the effect that the sheet is discharged from the discharge port.

The sheet is discharged to the discharge tray 201 in the back of the apparatus and the display section 302 screen-displays to the effect that the discharged sheet is discharged because the sheet cannot be sorted. Therefore, a user can more surely grasp that the sheet is discharged.

A long sheet that cannot be sorted and discharged to the discharge trays on the basis of the success determination concerning a decolored state is discharged to the discharge tray 201 in the back of the apparatus via a linear sheet conveying path. Therefore, it is possible to set conveying path length to sheet discharge as short as possible. Consequently, it is possible to suppress occurrence of a sheet jam (so-called jam).

Figure 5:
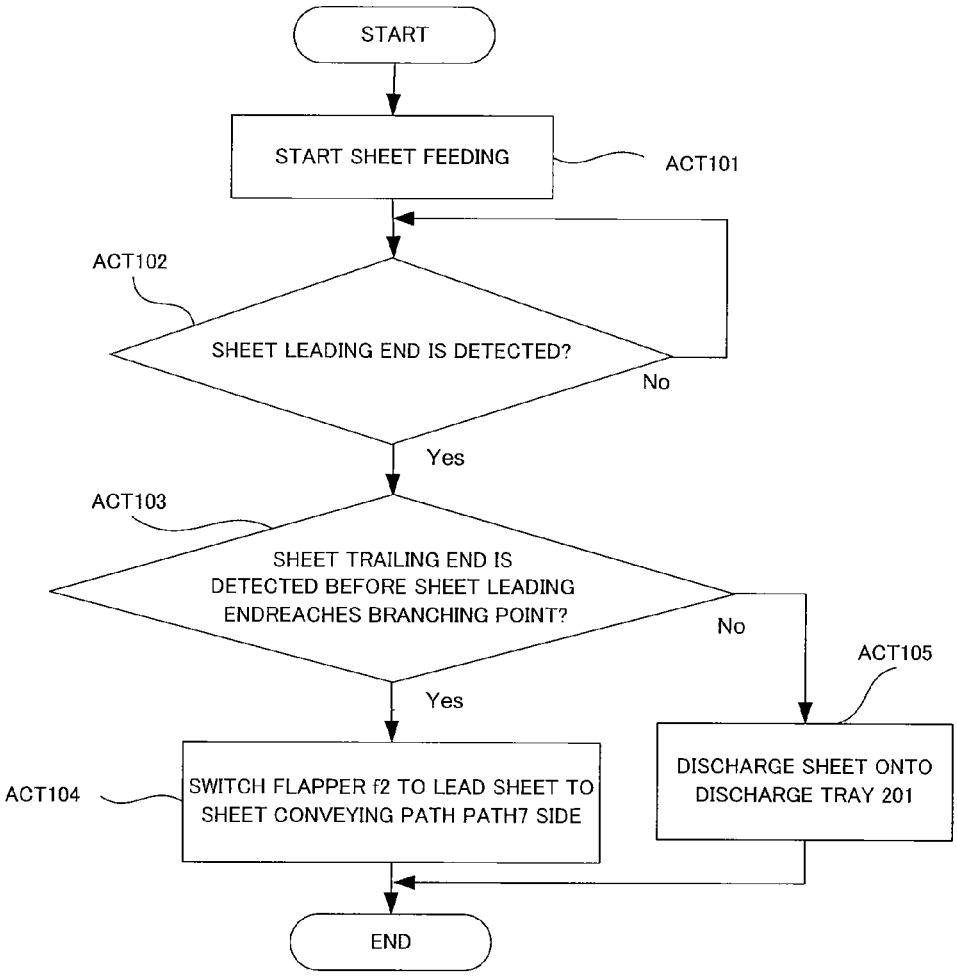
FIG. 5 is a flowchart for explaining an example of a flow of processing in the decoloring apparatus E.

FIG. 5 is a flowchart for explaining an example of a flow of processing in the decoloring apparatus E. In the decoloring apparatus E, sheet length detection by the sensor S is performed simultaneously with execution of the decoloring processing by the decoloring processing section 103.

Figure 6:
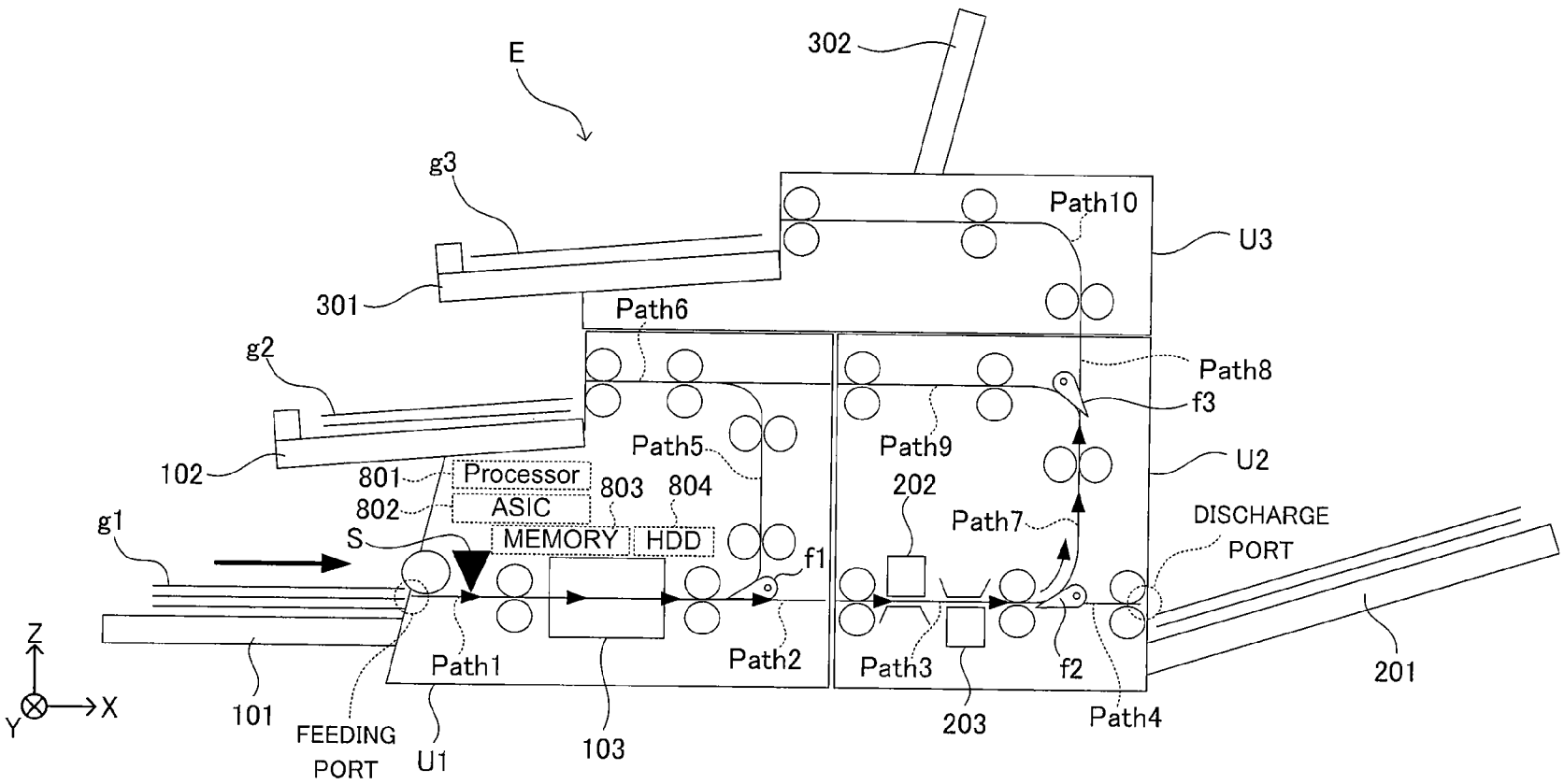
FIG. 6 is a diagram of a state in which a flapper f2 is switched to lead a sheet to a sheet conveying path Path7 side.

First, the processor 801 feeds a sheet to be subjected to decoloring processing to the conveying paths (ACT 101). After the leading end of the sheet is detected by the sensor S (ACT 102), if the trailing end of the sheet is detected by the sensor S before the leading end of the sheet reaches the branching point of the flapper f2 (Yes in ACT 103), the processor 801 switches the flapper f2 to lead the sheet to the sheet conveying path Path7 side (ACT 104) (see an angle of the flapper f2 and an arrow in FIG. 6).

On the other hand, if the trailing end of the sheet is not detected by the sensor S before the leading end of the sheet reaches the branching point of the flapper f2 (No in ACT 103), the flapper f2 does not move in the state shown in FIG. 1 and discharges the sheet onto the discharge tray 201 (ACT 105).

In the example explained above, the operation of the flapper at the branching point is controlled on the basis of a detection result of sheet length in the sensor S. However, the embodiment is not always limited to this. For example, it is also possible that the thickness of the sheet is detected by the sensor S and, if it is determined that the thickness is not suitable for sorting and discharge to the discharge trays, the sheet is discharged to the discharge tray 201 via the linear sheet conveying path.

Further, a computer program for causing a computer included in the decoloring apparatus E to execute the operations explained above can be provided. In the example explained in this embodiment, the computer program for realizing a function of carrying out the configurations described herein is stored in advance in a storage area provided on the inside of the apparatus. However, the embodiment is not limited to this. The same computer program may be downloaded from a network to the apparatus. The same computer program stored in a computer-readable recording medium may be installed in the apparatus. A form of the recording medium maybe any form as long as the recording medium is a recording medium that can store the computer program and can be read by the computer. Specifically, examples of the recording medium include an internal storage device internally mounted on the computer such as a ROM or a RAM, a portable storage medium such as a CD-ROM, a flexible disk, a DVD disk, a magneto-optical disk, or an IC card, a database that stores a computer program, other computers and databases thereof, and a transmission medium on a line. Functions obtained by installation or download in advance in this way may be realized in cooperation with an OS (operating system) or the like on the inside of the apparatus.

The computer program may be an execution module dynamically generated partially or entirely.

It goes without saying that it is also possible to cause the ASIC 802 to execute, in terms of a circuit, at least apart of the various kinds of processing realized by causing the processor to execute the computer program in this embodiment.

In the example explained in this embodiment, all of the processor 801, the ASIC 802, the memory 803, and the HDD 804 are included in the unit U1. However, the embodiment is not limited to this. Specifically, if the decoloring apparatus E as a whole can realize functions that should be included in the decoloring apparatus E, the processor 801, the ASIC 802, the memory 803, and the HDD 804 may be arranged in any one of the units. Similarly, the units U2 to U4 may include the processing functions same as those in the unit U1.

Second Embodiment

A second embodiment is explained with reference to the drawings. The second embodiment is a modification of the first embodiment. A basic apparatus configuration of the second embodiment is the same as that of the first embodiment. Components same as those explained in the first embodiment are denoted by the same reference numerals and signs and explanation of the components is omitted.

In a decoloring apparatus that decolors, through predetermined decoloring processing, an image formed on a sheet with a decolorable colorant, there is known a configuration including a function of reading, with a scanner, an undecolored image or the like on the sheet and determining whether the decoloring processing is sufficiently performed.

Scanning for such determination processing and arithmetic processing for determination require a certain degree of time. Therefore, the throughput of processing of the apparatus as a whole falls.

Figure 7:
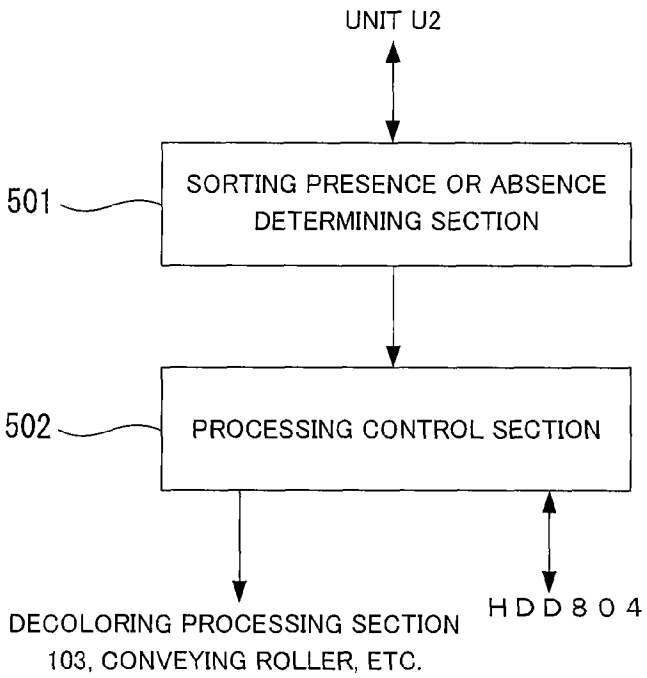
FIG. 7 is a diagram of functional blocks in a decoloring apparatus E' according to a second embodiment.

FIG. 7 is a diagram of functional blocks in a decoloring apparatus E' according to the first embodiment.

The decoloring apparatus E' according to the second embodiment includes a sorting presence or absence determining section 501 and a processing control section 502.

The sorting presence or absence determining section 501 determines presence or absence of a sorting section (equivalent to the unit U2 shown in FIG. 1) configured to switch a conveyance destination of the sheet after the decoloring processing on the basis of image data obtained by reading an image on a sheet decolored by the decoloring processing section 103.

If the sorting presence or absence determining section 501 determines that the sorting section is present, the processing control section 502 sets heating temperature by the decoloring processing section 103 higher than heating temperature set when the sorting presence or absence determining section 501 determines that the sorting section is absent. The processing control section 502 sets sheet conveying speed in the sheet conveying path Path1 and the like high when the decoloring processing is applied by the decoloring processing section 103.

Figure 8:
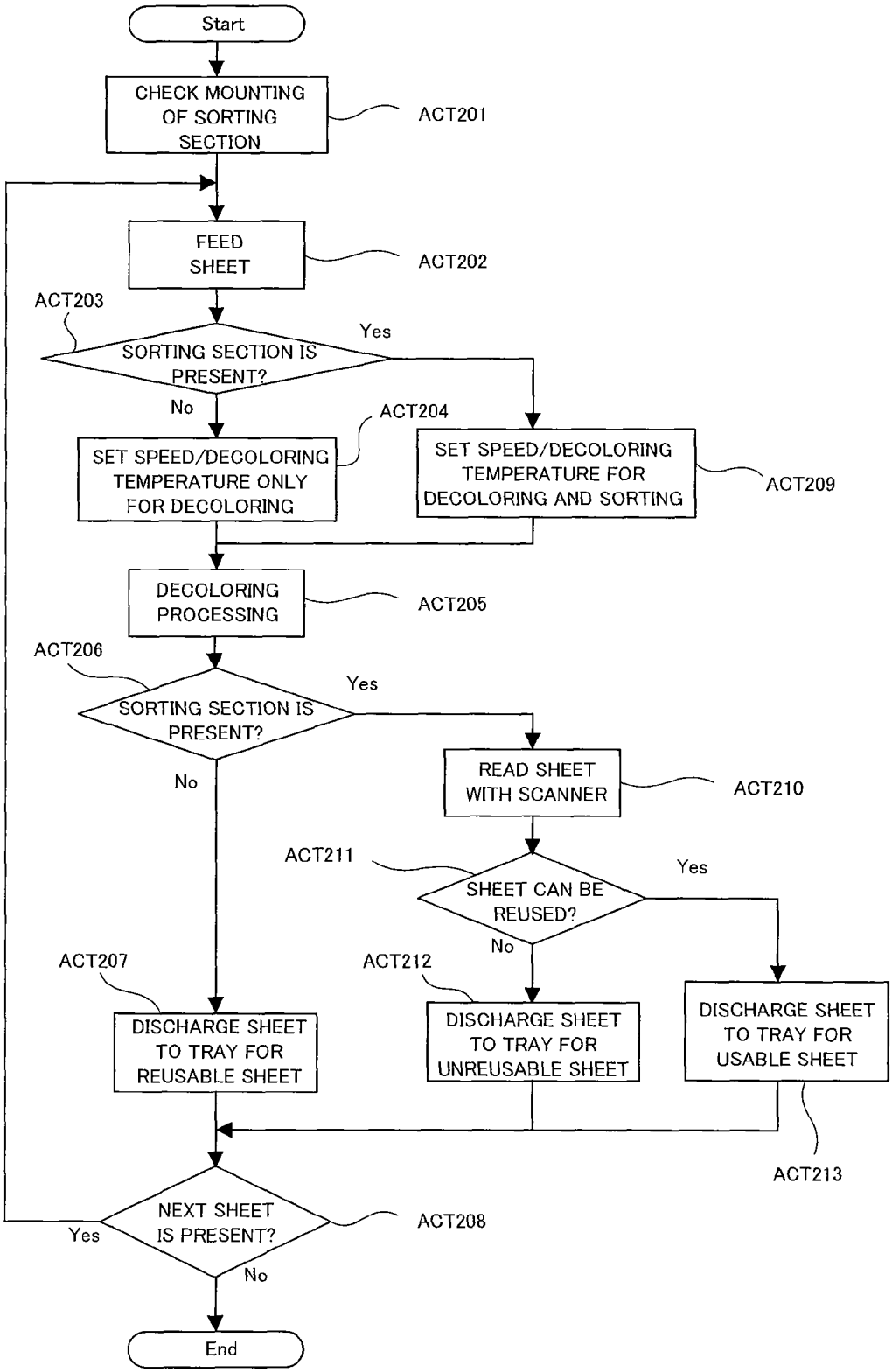
FIG. 8 is a flowchart for explaining an example of a flow of processing in the decoloring apparatus E'.

FIG. 8 is a flowchart for explaining an example of a flow of processing in the decoloring apparatus E'.

First, the processor 801 checks whether the unit U2 functioning as the sorting section having a sorting function is mounted on the decoloring apparatus E' (ACT 201). As a method of checking presence or absence of the mounting of the unit U2, a publicly-known method such as check of possibility of communication or detection by a sensor can be used.

Subsequently, the processor 801 feeds a sheet from the sheet feeding tray 101 (ACT 202).

If the unit U2 is not mounted on the unit U1 (No in ACT 203), the processor 801 causes the decoloring processing section 103 to perform decoloring processing under predetermined decoloring conditions set according to the sheet (ACTS 204 and 205).

Examples of the predetermined decoloring conditions include (1) heating temperature by the decoloring processing section 103 and (2) sheet conveying speed in a sheet conveying path in applying the decoloring processing.

On the other hand, if the unit U2 is mounted on the unit U1 (Yes in ACT 203), in order to eliminate a time delay due to execution of sorting processing in the unit U2, the processor 801 heats the sheet at temperature higher than heating temperature by the decoloring processing section 103 in applying the decoloring processing in ACT 205 and conveys the sheet at speed higher than sheet conveying speed in the sheet conveying path in applying the decoloring processing in ACT 205 (ACT 209).

Subsequently, if the unit U2 is not mounted on the unit U1 (No in ACT 206), the processor 801 discharges the sheet after the decoloring processing onto the discharge tray 102 (ACT 207).

The processor 801 repeats the processing in ACT 202 and subsequent steps until there is no more next sheet (ACT 208).

If the unit U2 is mounted on the unit U1 (Yes in ACT 206), the processor 801 reads an image of the sheet after the decoloring processing with the scanners 202 and 203 (ACT 210). If it is determined from a result of the reading that the sheet is sufficiently subjected to the decoloring processing and can be reused (Yes in ACT 211), the processor 801 discharges the decolored sheet, for example, onto the discharge tray 301 (ACT 213).

On the other hand, if it is determined from the reading result that the sheet is sufficiently subjected to the decoloring processing and cannot be reused (No in ACT 211), the processor 801 discharges the decolored sheet, for example, onto the discharge tray 102 (ACT 212).

According to the second embodiment, even if a unit having the sorting function is additionally mounted on the decoloring apparatus, it is possible to satisfactorily maintain the throughput of processing of the decoloring apparatus as a whole.

According to the second embodiment explained above, for example, techniques described in (1) and (2) below can be provided.

(1) A decoloring apparatus including:

a sheet conveying path for conveying a sheet;

a decoloring processing section configured to heat an image formed with a decolorable colorant on a sheet conveyed through the sheet conveying path to thereby decolor the image;

a sorting presence or absence determining section configured to determine presence or absence of a sorting section configured to switch a conveyance destination of the sheet after decoloring processing on the basis of image data obtained by reading the image on the sheet decolored by the decoloring processing section; and a processing control section configured to set, if the sorting presence or absence determining section determines that the sorting section is present, heating temperature by the decoloring processing section higher than heating temperature set when the sorting presence or absence determining section determines that the sorting section is absent and set sheet conveying speed in the sheet conveying path high when the decoloring processing section applies the decoloring processing.

(2) The apparatus of (1), wherein the sorting section includes a communication function, and the sorting presence or absence determining section determines presence or absence of the sorting section on the basis of whether communication with the sorting section can be established.

Third Embodiment

A third embodiment is explained with reference to the drawings. The third embodiment is a modification of the embodiments explained above. A basic apparatus configuration of the third embodiment is the same as that of the embodiments. Components having functions same as those of the components explained in the first embodiment are denoted by the same reference numerals and signs and explanation of the components is omitted.

In a decoloring apparatus that decolors, through predetermined decoloring processing, an image formed on a sheet with a decolorable colorant, there is known a configuration including a function of reading, with a scanner, an undecolored image or the like remaining on the sheet and determining whether the decoloring processing is sufficiently performed and the sheet is suitable for reuse.

Scanning for such determination processing and arithmetic processing for determination require a certain degree of time. Therefore, the throughput of processing of the apparatus as a whole falls.

Figure 9:
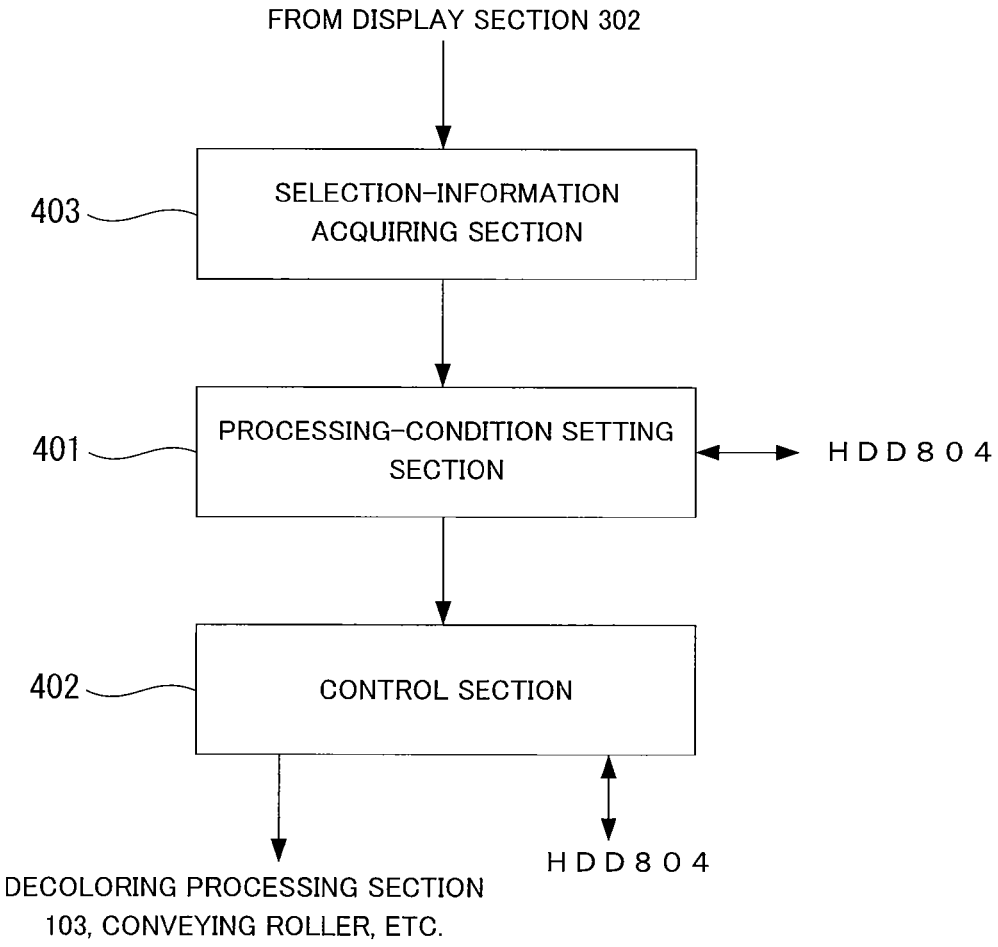
FIG. 9 is a diagram of functional blocks in a decoloring apparatus E" according to a third embodiment.

FIG. 9 is a diagram of functional blocks in a decoloring apparatus E" according to the third embodiment.

The decoloring apparatus E" according to the third embodiment includes a processing-condition setting section 401, a control section 402, and a selection-information acquiring section 403.

The sensor S of the decoloring apparatus E" according to the third embodiment is located further on an upstream side than a branching point in a direction of sheet conveyance by a sheet conveying path and detects a type of a sheet to be subjected to decoloring processing. The detected sheet type is stored in the HDD 804 or the like.

The processing-condition setting section 401 sets setting parameters for determining processing conditions in the decoloring processing section 103 according to the type of the sheet to be subjected to the decoloring processing.

If plural sheets continuously conveyed through the sheet conveying path are subjected to the decoloring processing in the decoloring processing section, the control section 402 causes the decoloring processing section 103 to execute decoloring processing with the setting parameters, which are set by the processing-condition setting section 401 concerning "a first sheet among the plural sheets", in the same manner concerning "a sheet detected as the same type as the first sheet by the sensor S".

The control section 402 causes the sensor S to perform the type detection concerning the second and subsequent sheets among the plural sheets and compares types detected concerning the second and subsequent sheets and the type detected concerning the first sheet and stored in the HDD 804 or the like. The control section 402 causes the flapper f2 to lead a sheet detected as a type different from the first sheet by the sensor S to the discharge tray 102 or the discharge tray 301, which is a second conveyance destination, and sort the sheet.

The sensor S detects at least any one of the following as a type of a sheet to be subjected to the decoloring processing:

(1) the size of the sheet;

(2) the material of the sheet;

(3) the thickness of the sheet; and (4) the surface roughness of the sheet.

The selection-information acquiring section 403 acquires, on the basis of an operation input to the display section 302 functioning as an operation input section, type selection information (e.g., "A4", "glossy paper", and "thick paper") for selecting which type among plural types a group of sheets continuously fed as sheets to be decolored mainly are.

The control section 402 causes the decoloring processing section 103 to execute decoloring processing with the setting parameters, which are set by the processing-condition setting section 401 concerning a sheet of the type indicated by the type selection information acquired by the selection-information acquiring section 403, in the same manner concerning a sheet detected as the same type as the first sheet by the sensor S. The control section 402 causes the flapper f2 to lead a sheet detected by the sensor S as a type different from the type indicated by the type selection information acquired by the selection-information acquiring section 403 to the discharge tray 102 or the discharge tray 301, which is the second conveyance destination, and sort the sheet.

If plural sheets continuously conveyed through the sheet conveying path are subjected to the decoloring processing in the decoloring processing section, the control section 402 can cause the decoloring processing section 103 to execute a part or all of the decoloring processing corresponding to the setting parameters, which are set by the processing-condition setting section concerning a first sheet among the plural sheets, in the same manner concerning a sheet detected as the same type as the first sheet by the sensor S.

Figure 10:
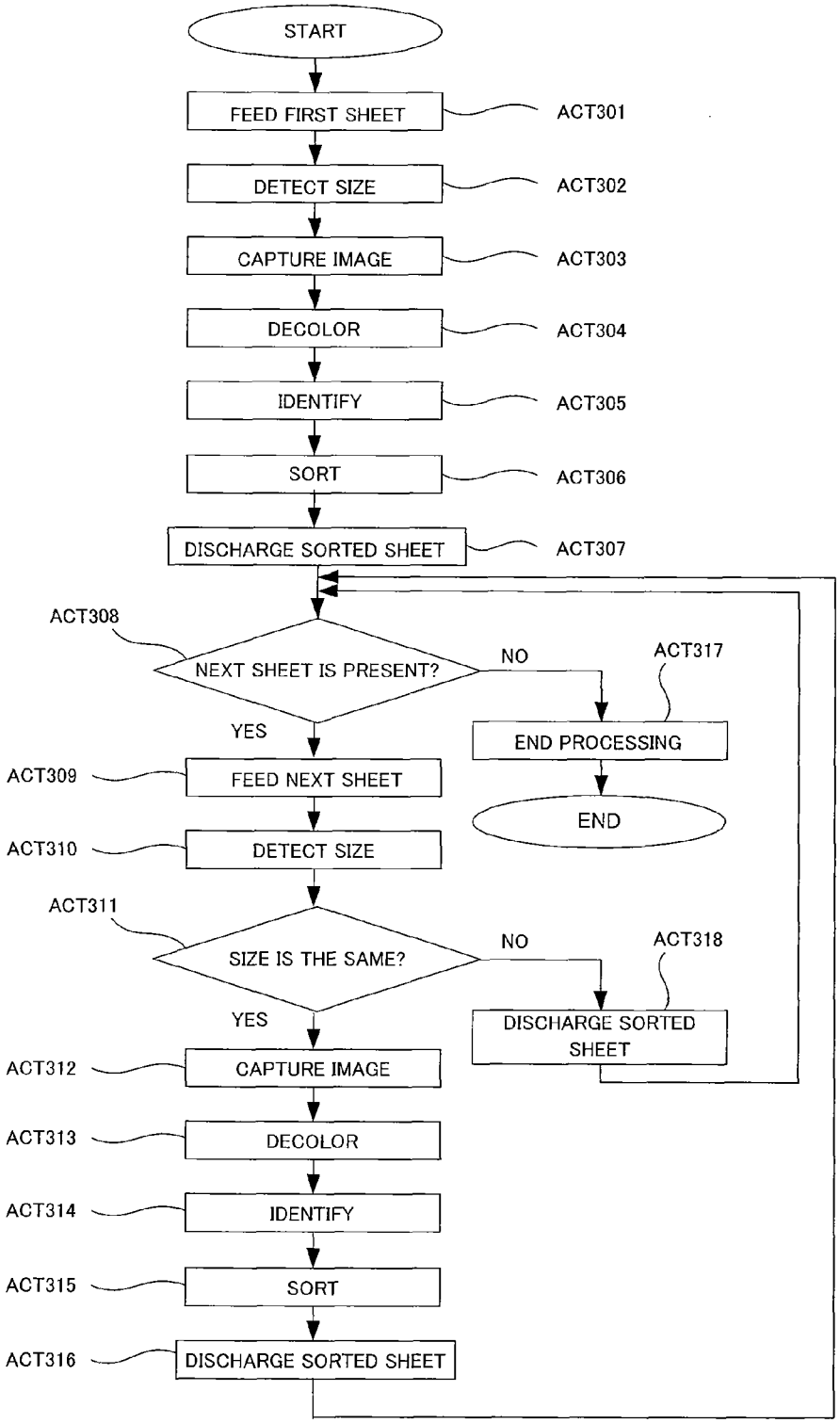
FIG. 10 is a flowchart for explaining an example of a flow of processing in the decoloring apparatus E".

FIG. 10 is a flowchart for explaining an example of a flow of processing in the decoloring apparatus E".

First, the processor 801 feeds a first sheet among a group of plural sheets to be decolored (ACT 301).

The sensor S detects the size of the sheet fed in ACT 301 (Act 302).

The sensor S reads an image on the sheet simultaneously with the detection of the size of the sheet (ACT 303).

Subsequently, the processor 801 causes the decoloring processing section 103 to execute decoloring processing on the sheet, the size of which is detected (ACT 304).

The processor 801 causes the scanners 202 and 203 to read the image on the sheet subjected to the decoloring processing (ACT 305).

Thereafter, the processor 801 determines, on the basis of, for example, contents of image data read by the scanners, whether the sheet can be reused (ACT 306). For example, if the image remains undecolored at density equal to or higher than predetermined density, the processor 801 determines that the sheet cannot be reused.

The processor 801 sorts and conveys, on the basis of a result of the determination, the sheet for which success of the decoloring processing and possibility of reuse are determined to any one of plural discharge trays such as the discharge tray 102 and the discharge tray 301 (ACT 307).

If there is no following next sheet (No in ACT 308), the processing ends (ACT 317). If there is the next sheet (Yes in ACT 308), the processor 801 starts feeding of the next sheet (ACT 309).

The sensor S detects, for example, the size of the next sheet fed in ACT 309 (ACT 310).

If the size of the next sheet is different from the size of the first sheet (No in ACT 311), the processor 801 sorts the sheet as a sheet to be discharged and discharges the sheet onto the discharge tray (ACT 318).

If the size of the next sheet is the same as the size of the first sheet (Yes in ACT 311), the processor 801 causes the sensor S to read an image on the sheet and causes the HDD 804 to store the image (ACT 312).

The processor 801 causes the decoloring processing section 103 to execute the decoloring processing on the sheet scanned in ACT 312 (ACT 313).

Thereafter, the processor 801 determines, on the basis of, for example, contents of image data read by the scanners, whether the sheet can be reused (ACTS 314 and 315). For example, if the image remains undecolored at density equal to or higher than predetermined density, the processor 801 determines that the sheet cannot be reused.

The processor 801 sorts and conveys, on the basis of a result of the determination, the sheet for which success of the decoloring processing and possibility of reuse are determined to any one of the plural discharge trays such as the discharge tray 102 and the discharge tray 301 (ACT 316).

According to the sheet conveyance control in the third embodiment, for example, if a group of sheets including mixed sheets of plural sizes are stacked on the sheet feeding tray 101, the decoloring processing with setting parameters automatically set to correspond to a type of a first sheet is applied in the same manner to a sheet having the same type as the first sheet among a group of sheets fed following the first sheet. A sheet of a type different from the first sheet is sorted and discharged to a different discharge destination without being subjected to the decoloring processing. Consequently, it is possible to improve the throughput of the processing as a whole.

According to the third embodiment explained above, for example, techniques described in (1) to (5) below can be provided.

(1) A decoloring apparatus including:

a decoloring processing section configured to decolor an image formed with a decolorable colorant on a sheet to be conveyed;

a sheet conveying path for conveying the sheet to the decoloring processing section, the sheet conveying path including a branch path that branches to a second conveyance destination different from the decoloring processing section at a branching point located further on an upstream side than the decoloring processing section;

a flapper configured to switch a conveyance destination of the sheet at the branching point;

a sensor located further on the upstream side than the branching point in a direction of sheet conveyance by the sheet conveying path and configured to detect a type of the sheet to be subjected to the decoloring processing;

a processing-condition setting section configured to set setting parameters for determining processing conditions in the decoloring processing section according to the type of the sheet to be subjected to the decoloring processing; and a control section configured to cause, if plural sheets continuously conveyed through the sheet conveying path are subjected to the decoloring processing in the decoloring processing section, the decoloring processing section to execute decoloring processing with the setting parameters, which are set by the processing-condition setting section concerning a first sheet among the plural sheets, in the same manner concerning a sheet detected as the same type as the first sheet by the sensor and causes the flapper to lead a sheet detected as a type different from the first sheet by the sensor to the second conveyance destination.

(2) The apparatus of (1), wherein the sensor detects, as the type of the sheet to be subjected to the decoloring processing, at least any one of the size of the sheet, the material of the sheet, the thickness of the sheet, and the surface roughness of the sheet.

(3) The apparatus of (1), further including:

an operation input section configured to receive an operation input of a user; and a selection-information acquiring section configured to acquire, on the basis of an operation input to the operation input section, type selection information for selecting which type among plural types a group of sheets continuously fed as sheets to be decolored mainly are, wherein the control section causes the decoloring processing section to execute decoloring processing with the setting parameters, which are set by the processing-condition setting section concerning the sheet of the type indicated by the type selection information acquired by the selection-information acquiring section, in the same manner concerning a sheet detected as the same type as the first sheet by the sensor and causes the flapper to lead a sheet detected by the sensor as a type different from the type indicated by the type selection information acquired by the selection-information acquiring section to the second conveyance destination.

(4) The apparatus of (1), wherein the sensor is a scanner configured to read the image on the sheet subjected to the decoloring processing by the decoloring processing section.

(5) The apparatus of (1), wherein the control section causes, if plural sheets continuously conveyed through the sheet conveying path are subjected to the decoloring processing in the decoloring processing section, the decoloring processing section to execute apart or all of decoloring processing with the setting parameters, which are set by the processing-condition setting section concerning a first sheet among the plural sheets, in the same manner concerning a sheet detected as the same type as the first sheet by the sensor.

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. A decoloring apparatus comprising:

a first sheet conveying path for guiding a sheet, which is fed from a feeding port, to a discharge port;

a second sheet conveying path that branches from the first sheet conveying path, for guiding the sheet conveyed through the first sheet conveying path to another conveyance destination;

a decoloring processing section configured to decolor an image formed with a decolorable colorant on the sheet at a location between the feeding port and a branching point where the second sheet conveying path branches from the first sheet conveying path;

a first flapper configured to switch a destination of the sheet conveyed through the first sheet conveying path to be the discharge port in the first sheet conveying path or the second sheet conveying path;

an image reading section located between the decoloring processing section and the branching point and configured to read the image on the sheet decolored by the decoloring processing section;

a sensor located between the feeding port and the decoloring processing section and configured to detect a leading end and a trailing end of the sheet conveyed through the first sheet conveying path; and a path control section configured to control the first flapper so that the destination of the sheet through the first sheet conveying path is the discharge port when the sensor does not detect the trailing end of the sheet within a time from when the sensor detects the leading end of the sheet to when the leading end of the sheet arrives at the branching point.

2. The apparatus according to claim 1, wherein the path control section is configured to control the first flapper so that the destination of the sheet through the first sheet conveying path is the second sheet conveying path when the sensor detects the trailing end of the sheet within the time.

3. The apparatus according to claim 1, wherein the second sheet conveying path branches to plural conveying paths for conveying the sheet to plural conveyance destinations, and the apparatus further comprises:

a success determining section configured to determine success of the decoloring processing on the sheet on the basis of image data read by the image reading section; and a second flapper configured to convey the sheet to any one of the plural conveyance destinations, and wherein the path control section is configured to switch a state of the second flapper on the basis of a result of the determination by the success determining section.

4. The apparatus according to claim 1, wherein the first sheet conveying path is a linear conveying path.

5. The apparatus according to claim 3, further comprising:

a storing section configured to store image data read from the sheet by the image reading section; and a storage control section configured to not cause the storing section to store the image data needed for the success determination by the success determining section, if the trailing end of the sheet is not detected by the sensor within the predetermined time after the leading end of the sheet is detected by the sensor.

6. The apparatus according to claim 5, wherein if the trailing end of the sheet is not detected by the sensor within the predetermined time after the leading end of the sheet is detected by the sensor, the storage control section instructs the image reading section to stop the image reading process.

7. The apparatus according to claim 3, wherein the path control section is configured to cause the second flapper to not operate if the trailing end of the sheet is not detected by the sensor within the predetermined time after the leading end of the sheet is detected by the sensor.

8. The apparatus according to claim 3, further comprising plural conveying rollers configured to perform sheet conveyance in each of the plural conveying paths, wherein the path control section is configured to not drive any one of the plural conveying rollers if the trailing end of the sheet is not detected by the sensor within the predetermined time after the leading end of the sheet is detected by the sensor.

9. The apparatus according to claim 1, further comprising:

a display section configured to display information concerning processing in the decoloring apparatus; and a display control section configured to cause the display section to display information that the sheet has been discharged from the discharge port, if the path control section changes the first flapper to the state that causes the sheet to be conveyed to the discharge port.

10. A sheet conveyance control method in a decoloring apparatus including: a first sheet conveying path for guiding a sheet, which is fed from a feeding port, to a discharge port; a second sheet conveying path that branches from the first sheet conveying path for guiding the sheet conveyed through the first sheet conveying path to another conveyance destination; and a decoloring processing section configured to decolor an image formed with a decolorable colorant on the sheet at a location between the feeding port and a branching point where the second sheet conveying path branches from the first sheet conveying path, the method comprising:

reading the image on the sheet by an image reading section located between the decoloring processing section and the branching point and configured to read the image on the sheet decolored by the decoloring processing section;

detecting a leading end and a trailing end of the sheet conveyed through the first sheet conveying path at a location between the feeding port and the decoloring processing section; and controlling a first flapper so that the destination of the sheet through the first sheet conveying path is the discharge port when the trailing end of the sheet is not detected at the location between the feeding port and the decoloring processing section within a time from when the leading end of the sheet is detected at the location between the feeding port and the decoloring processing section to when the leading end of the sheet arrives at the branching point.

11. The method according to claim 10, further comprising controlling the first flapper so that the destination of the sheet through the first sheet conveying path is the second sheet conveying path when the trailing end of the sheet is detected at the location between the feeding port and the decoloring processing section within the time.

12. The method according to claim 10, wherein the second sheet conveying path branches to plural conveying paths for conveying the sheet to plural conveyance destinations, the apparatus further includes:

a success determining section configured to determine success of the decoloring processing on the sheet on the basis of image data read by the image reading section; and a second flapper configured to convey the sheet to any one of the plural conveyance destinations, and wherein the second flapper is switched on the basis of a result of the determination in the success determining section.

13. The method according to claim 10, wherein the first sheet conveying path is a linear conveying path.

14. The method according to claim 12, further comprising not causing, a storing section to store the image data needed for the success determination in the success determining section, if the trailing end of the sheet is not detected within the predetermined time after the leading end of the sheet is detected.

15. The method according to claim 12, further comprising not causing the second flapper to operate if the trailing end of the sheet is not detected within the predetermined time after the leading end of the sheet is detected.

16. The method according to claim 12, further comprising not driving any one of plural conveying rollers, which are configured to perform sheet conveyance in each of plural conveying paths, if the trailing end of the sheet is not detected within the predetermined time after the leading end of the sheet is detected.

17. The method according to claim 10, further comprising causing a display section to display information that the sheet has been discharged from the discharge port, if the first flapper is changed to the state that causes the sheet to be conveyed to the discharge port.

18. A decoloring apparatus comprising:

a first sheet conveying path for guiding a sheet, which is fed from a feeding port, to a discharge port;

a second sheet conveying path that branches from the first sheet conveying path, for guiding the sheet conveyed through the first sheet conveying path to another conveyance destination;

a decoloring processing section configured to decolor an image formed with a decolorable colorant on the sheet at a location between the feeding port and a branching point where the second sheet conveying path branches from the first sheet conveying path;

a first flapper configured to switch a destination of the sheet conveyed through the first sheet conveying path to be the discharge port in the first sheet conveying path or the second sheet conveying path;

an image reading section located between the decoloring processing section and the branching point and configured to read the image on the sheet decolored by the decoloring processing section;

a sensor located between the feeding port and the decoloring processing section and configured to detect a leading end and a trailing end of the sheet conveyed through the first sheet conveying path; and a path control section configured to control the first flapper so that the sheet is conveyed to the discharge port if the leading end of the sheet reaches the branching point before the trailing end of the sheet reaches the sensor.

19. The apparatus according to claim 18, wherein the path control section controls the first flapper so that the sheet is conveyed to the discharge port if the sensor does not detect the trailing end of the sheet during a time from a detection of the leading end by the sensor to an arrival of the leading end at the branching point.

* * * * *